US005803815A

United States Patent [19]

Kitchen

[11] Patent Number: 5,803,815

[45] Date of Patent: Sep. 8, 1998

[54] ECCENTRIC ARM AMUSEMENT RIDE

[75] Inventor: William Joel Kitchen, Longmont, Colo.

[73] Assignee: Skymax, Inc., Longmont, Colo.

[21] Appl. No.: 788,165

[22] Filed: Jan. 24, 1997

[51] Int. Cl.[6] ..... A63G 31/08

[52] U.S. Cl. ..... 472/44; 472/29

[58] Field of Search ..... 472/29, 30, 44, 472/131, 130, 106, 112

[56] References Cited

U.S. PATENT DOCUMENTS

| | | | |
|---|---|---|---|
| 1,660,139 | 2/1928 | Shellabarger . | |
| 1,987,004 | 1/1934 | Eyerly | 272/49 |
| 2,046,678 | 7/1935 | Eyerly | 272/36 |
| 2,229,966 | 1/1938 | Eyerly | 272/38 |
| 2,357,481 | 6/1943 | Mallon | 35/12 |
| 3,904,194 | 9/1975 | Schwarzkopf | 472/44 |
| 4,410,173 | 10/1983 | Böhme | 272/38 |
| 5,658,201 | 8/1997 | Kleimeyer et al. | 472/44 |

*Primary Examiner*—Kien T. Nguyen
*Attorney, Agent, or Firm*—Patent Law Offices of Rick Martin, P.C.

[57] ABSTRACT

The present invention is an amusement ride which whips a rider high into the air at the end of a long crane-like arm. The ride comprises an arm having a rider capsule at one end and a counterweight at the other. A pivot point is located on the arm at a point near the counterweight. The pivot point is not at the center point of the arm. The pivot point is attached to a fulcrum on a base. The base is of sufficient height so that the arm in operation oscillates through an arc of 170° without the counterweight contacting the ground. The rider capsule spins while the arm is oscillating. The effect of the ride is to subject riders first to a positive and then a negative "g" during the ride's operation.

19 Claims, 11 Drawing Sheets

ECCENTRIC ARM AMUSEMENT RIDE

FIELD OF INVENTION

The present invention relates to an eccentric arm amusement ride having a non-centric point of rotation. One end of the arm comprises a capsule in which the riders are seated. The end of the arm opposite the capsule comprises a counterweight which accelerates the rider capsule causing first positive "g"s and then negative "g"s as the rider capsule is launched to a vertical position and then beyond into an oscillation.

BACKGROUND OF THE INVENTION

Prior art teaches amusement rides whereby the riders are moved in an upward circular fashion. This is usually accomplished by the vertical rotation of a rider capsule at the end of an arm. The arm is usually balanced, and the rotational motion is the result of mechanical actuation.

Representative of the prior art is:

U.S. Pat. No. 1,660,139 (1928) to Shellabarger discloses an amusement device for use in playgrounds where the occupants complete a circular rotation about a horizontal support.

U.S. Pat. No. 1,987,004 (1934) to Eyerly discloses an amusement ride having a car opposite a counterweight which rotates about a central point.

U.S. Pat. No. 2,046,678 (1935) to Eyerly discloses an amusement ride having a car at the end of an arm which rotates vertically about a central point.

U.S. Pat. No. 2,229,966 (1938) to Eyerly discloses an amusement ride having cars at opposite ends of an arm rotated through a vertical plane.

U.S. Pat. No. 2,357,481 (1943) to Mallon discloses an apparatus having an arm and a fuselage which rotates through a horizontal plane for pilot training.

U.S. Pat. No. 4,410,173 (1983) to Bohme discloses a roller-coaster system having a passenger carriage moved in a circular path in a vertical plane.

The prior art is operated in a balanced mode by mechanical means. It is necessary to provide mechanical input to the system to keep the rides operating for the desired time. Generally no ride gives a rapid acceleration upward which would cause the rider to experience a negative "g" force. The present invention offers the new and non-obvious sensation of being launched upward as in a rocket launch. At the full height of the arm, the rider capsule oscillates back and forth on the arm and rotates to add further excitement to the ride.

SUMMARY OF THE INVENTION

The main aspect of the present invention is to provide an amusement ride capable of swinging riders through an arc by the use of a counterbalance for propulsion.

Another aspect of the present invention is to provide an amusement ride having a rider capsule which rotates about an axis.

Another aspect of the present invention is to provide an amusement ride which oscillates the rider capsule once it is launched upward.

Another aspect of the present invention is to provide an amusement ride which subjects the rider to positive "g"s as it rapidly accelerates upwards.

Another aspect of the present invention is to provide an amusement ride which subjects the rider to negative "g"s as it rapidly accelerates over the top of the arc of travel.

Other aspects of this invention will appear from the following description and appended claims, reference being made to the accompanying drawings forming a part of this specification wherein like reference characters designate corresponding parts in the several views.

The present invention is an amusement ride comprising an eccentric pivoting arm having a rider capsule mounted at the distal end. Unlike the prior art, the present invention does not rely on mechanical means to cause operation of the ride. It operates due to the imbalance caused by the excess weight of the counterweight at the proximal end of the pivoting arm. The distal end of the arm remote from the fulcrum supports a rider capsule. In operation, the distal end is launched upward by the counterweight. The launching of the arm upward causes the rider(s) to experience negative "g"s. The pivoting arm then oscillates back and forth about a fulcrum which in turn is attached to a base. The fulcrum is non-centrically located toward one end of the arm to create an out-of-balance effect. The rider capsule may hold any number of riders from one to one hundred twenty.

Even though the counterweight is the motive force for operating the ride, a mechanical assist means may also be used to start the ride in motion. It may comprise an air, electric, or hydraulic actuator. The arm oscillates back and forth in a series of diminishing arcs. Its oscillations may be dampened by the hydraulic actuator. As the arm oscillates, the rider capsule spins through several 360° turns. Once the arm stops oscillating, it is returned to the ground so the riders may disembark.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
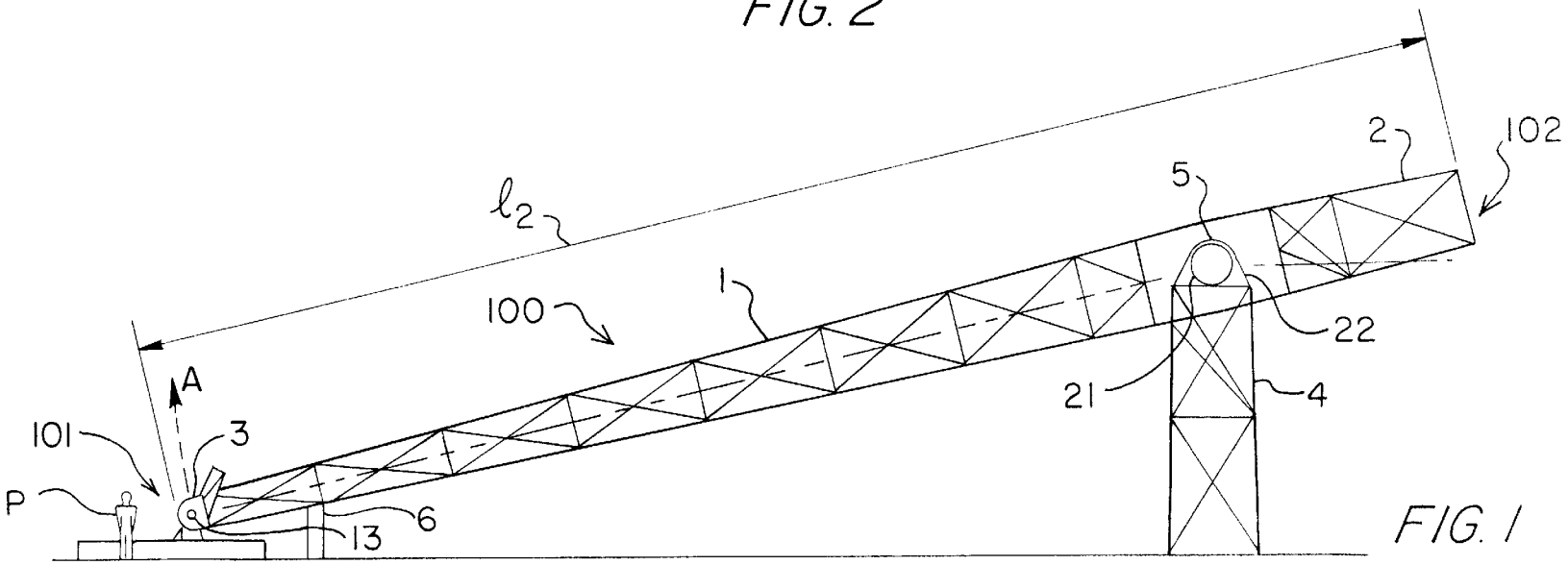
FIG. 1 is a side plan view of the preferred embodiment of the invention.

Referring first to FIG. 1 a side view of ride 100 depicts its general arrangement. Arm 1, of length $\mathbf{1}_2$ is rotatably attached to base 4 at fulcrum 5. Attached to the arm 1 at the distal end 101 (remote from the fulcrum 5) is a rider capsule 3. The fulcrum 5 may comprise an axle 21 and bearing 22. Bearing 22 may be a pillow block or other similar bearing. The proximal end 102 of arm 1 (opposite the rider capsule 3) supports a counterweight 2. The point of attachment of the arm 1 to fulcrum 5 is non-centric, that is, it is not at the mid-point of the arm 1. The fulcrum 5 is generally located between ⅓ and ⅕th of the length of the arm 1 from the counterweight 2. Arm 1 is lowered to the release 6 which holds it in place.

Figure 2:
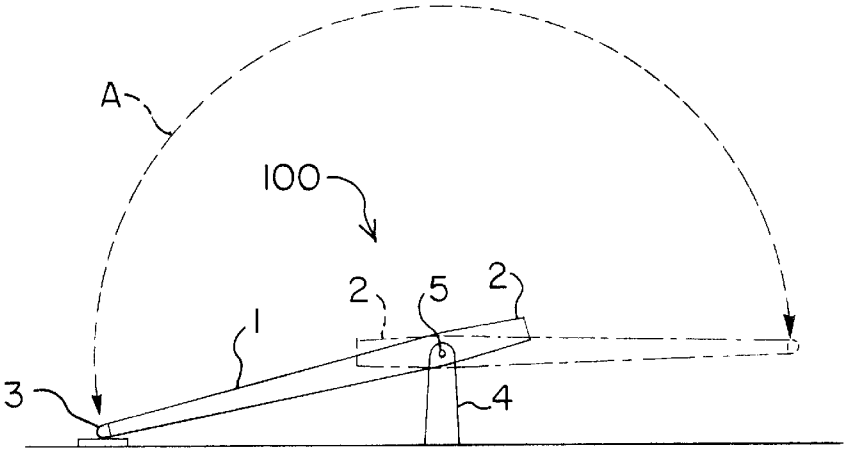
FIG. 2 is a side plan view of the preferred embodiment showing the operational movement of the arm.

FIG. 2 depicts the operational motion of the arm 1. Rider capsule 3 travels through arc A once released from release 6. Counterweight 2 is heavier than the arm 1 plus the weight of the rider capsule 3. This causes the arm 1 to "whip" the rider capsule through the arc A upon release. Rider capsule 3 rotates or spins as the arm 1 oscillates adding to the effect of inducing negative "g"s on the rider(s).

Figure 7:
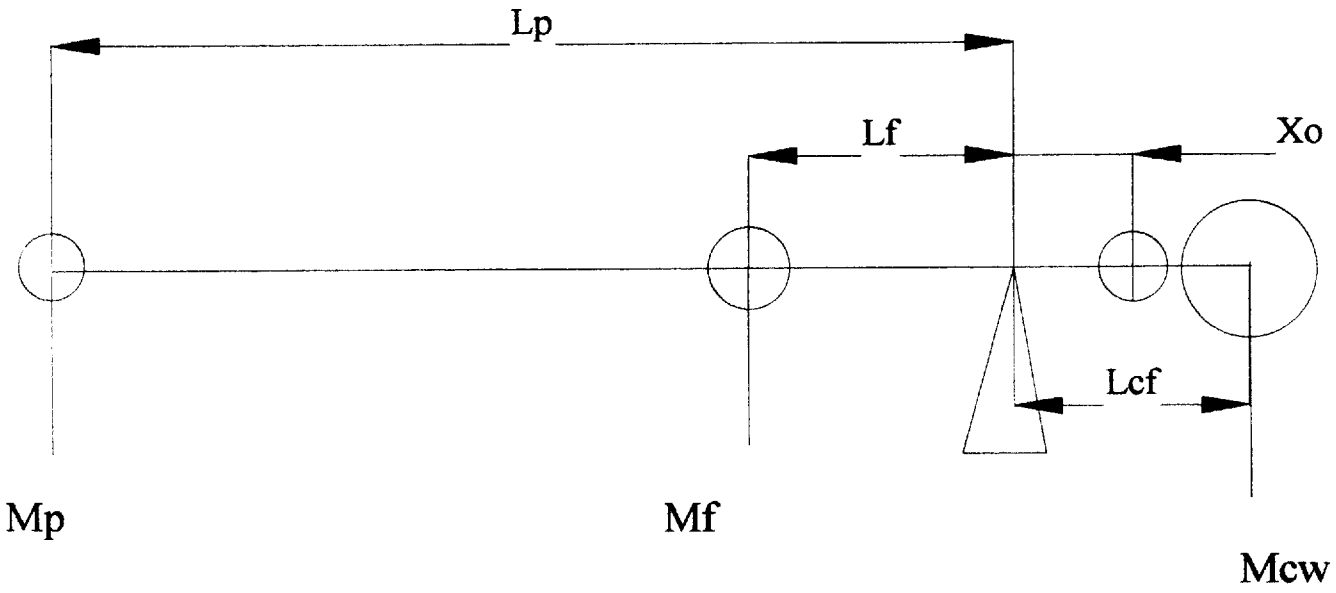
FIG. 7 is a free-body diagram of the invention.
Figure 10:
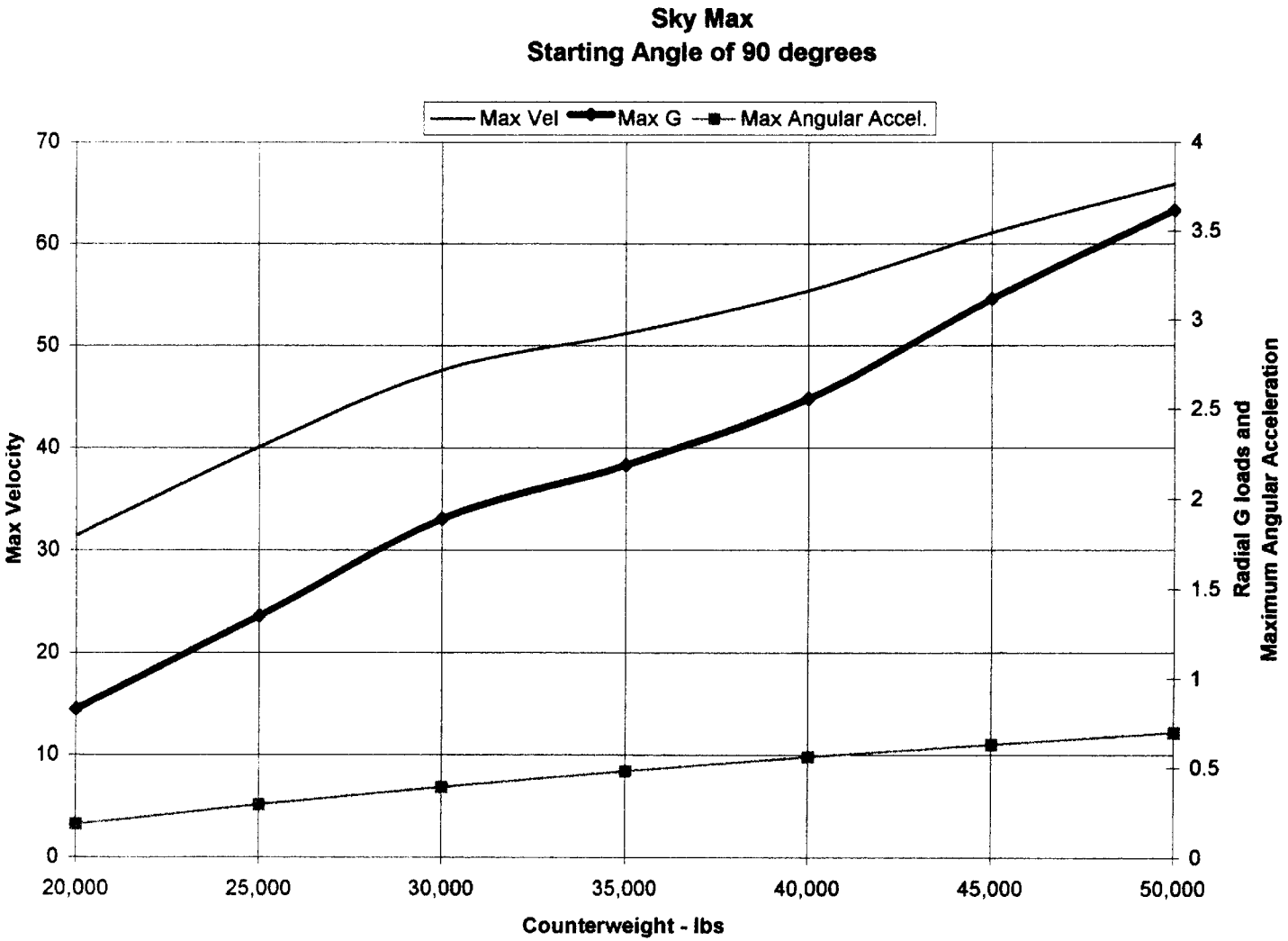
FIGS. 10–15 graphically depict solutions to the equations described for FIG. 7.
Figure 11:
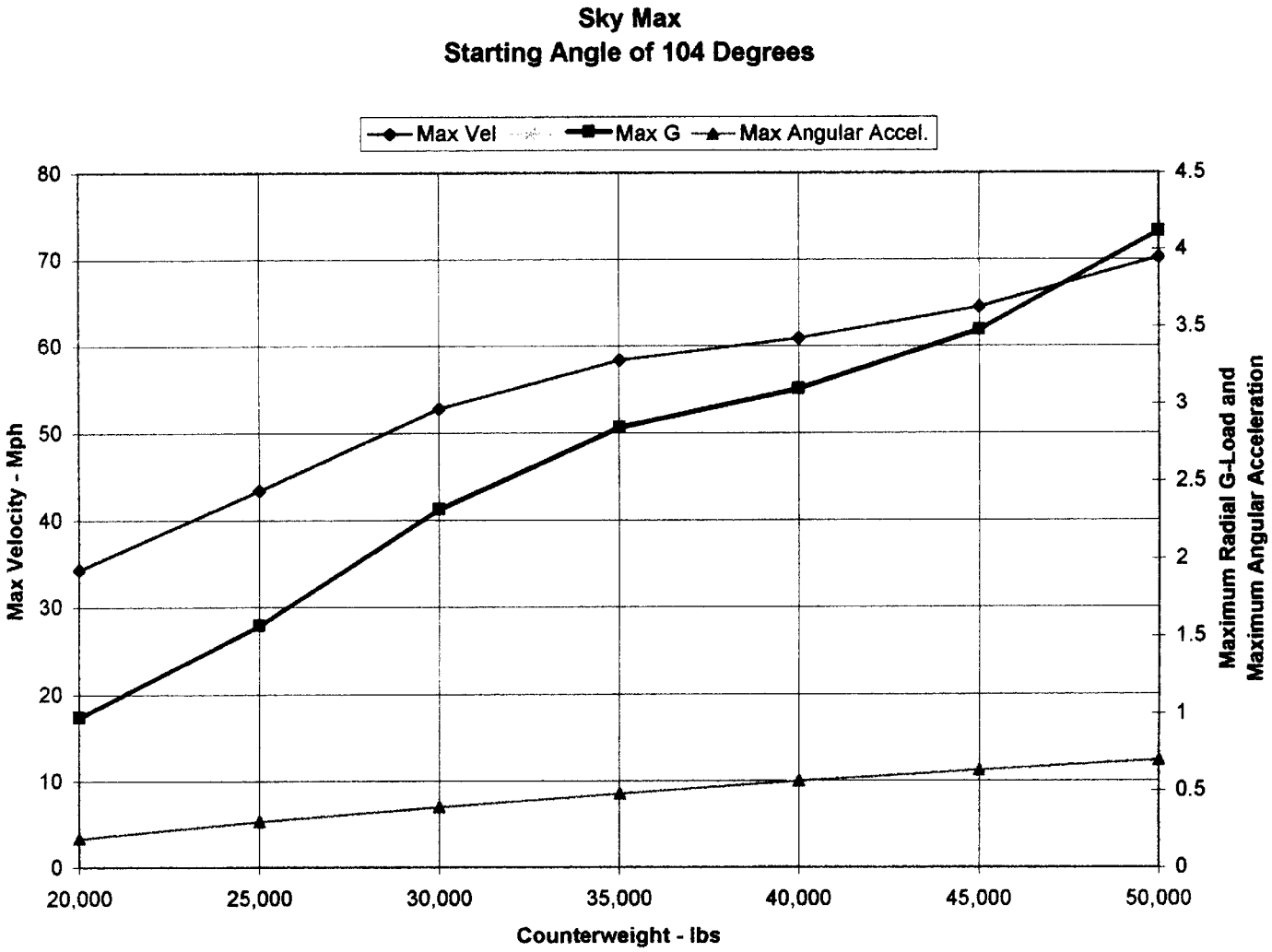
Figure 12:
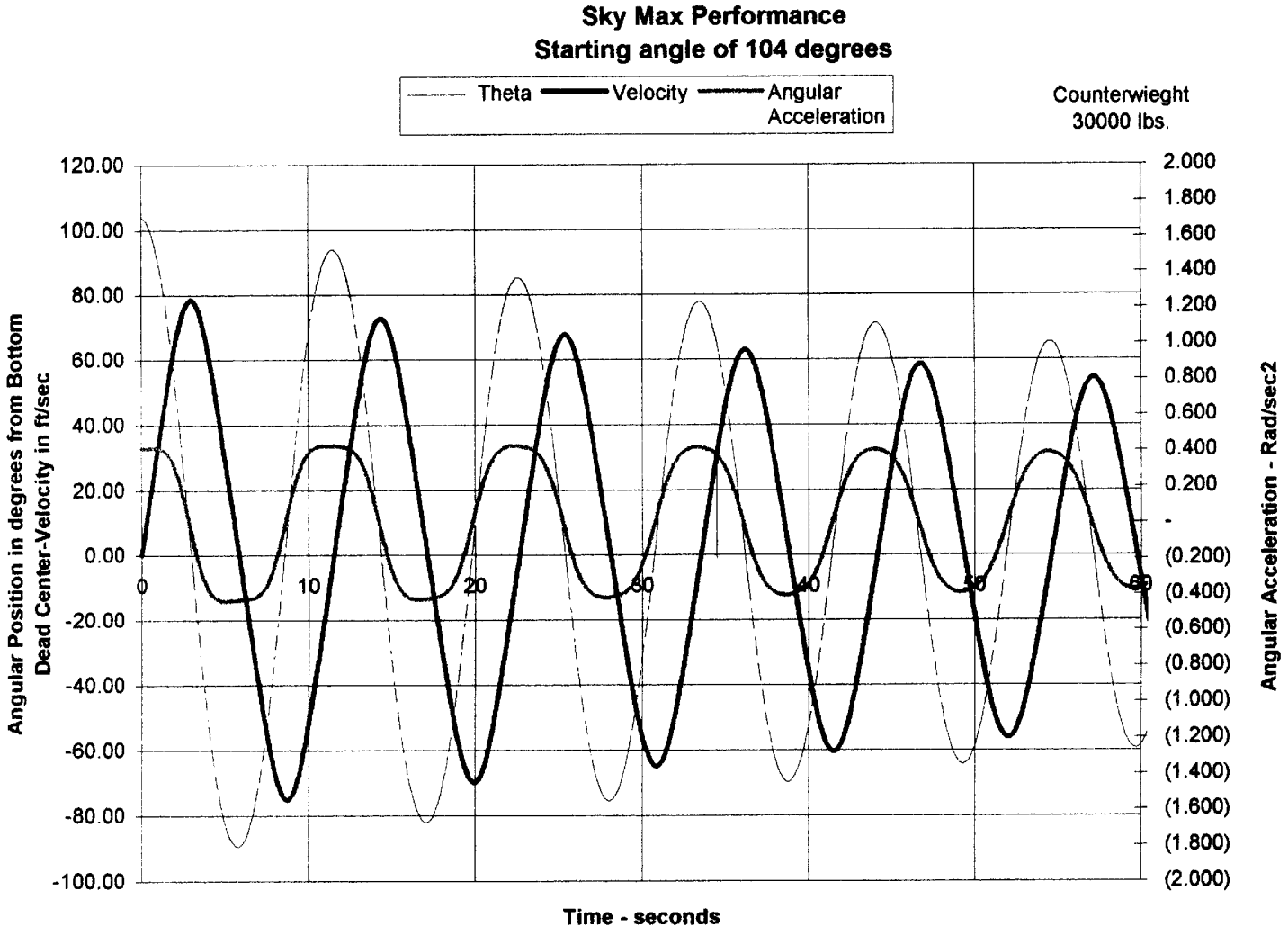
Figure 13:
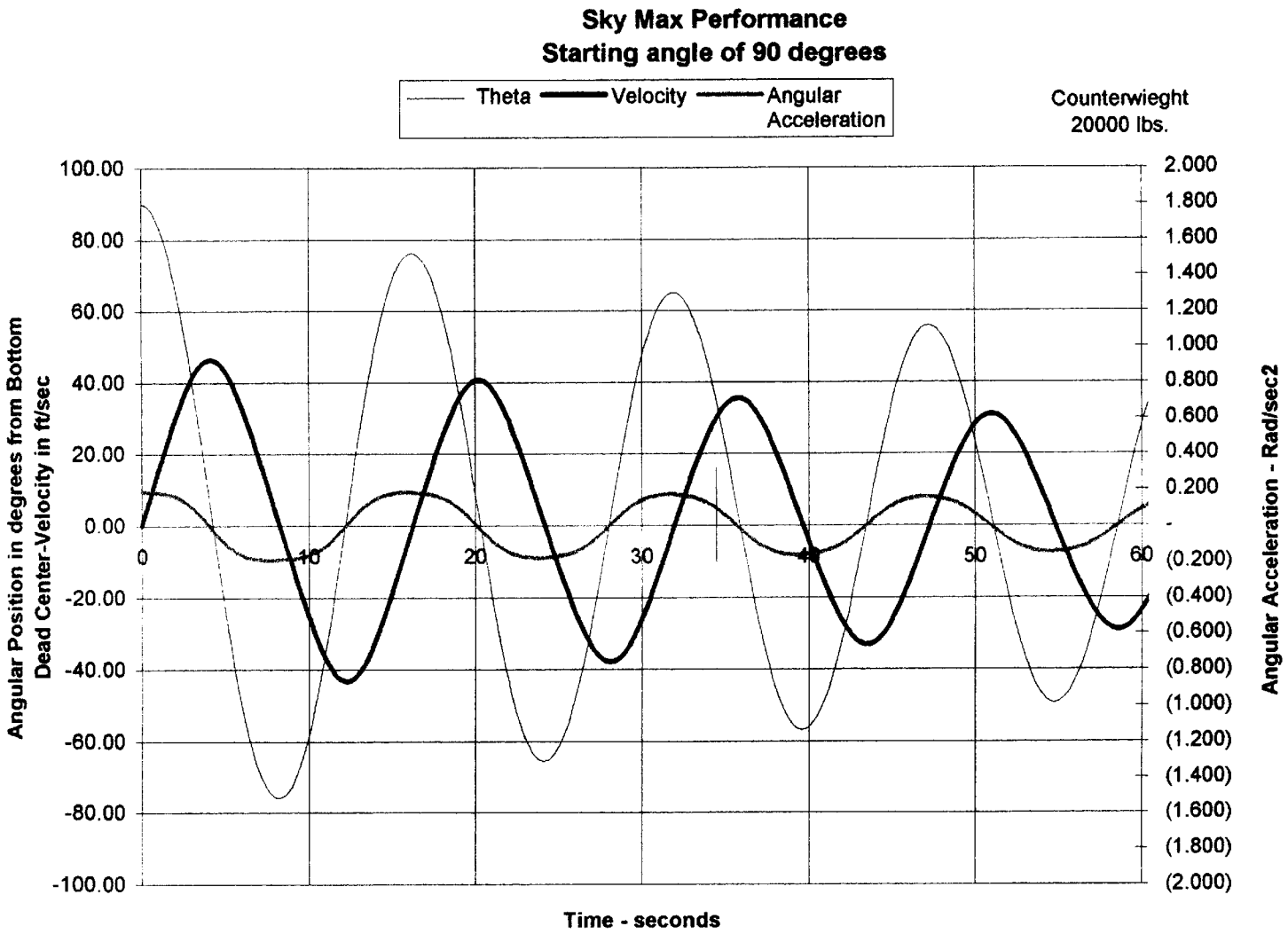
Figure 14:
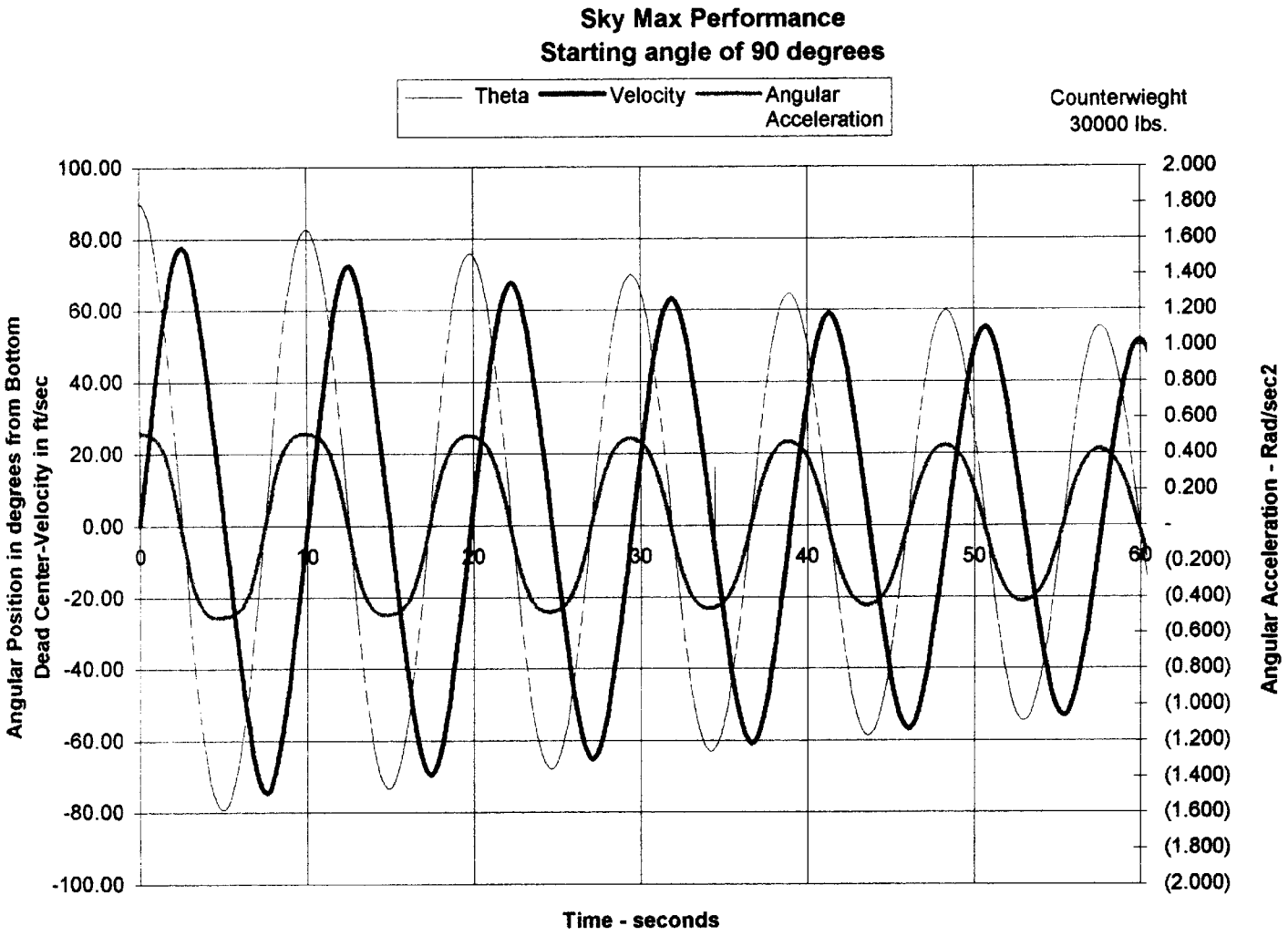
Figure 15:
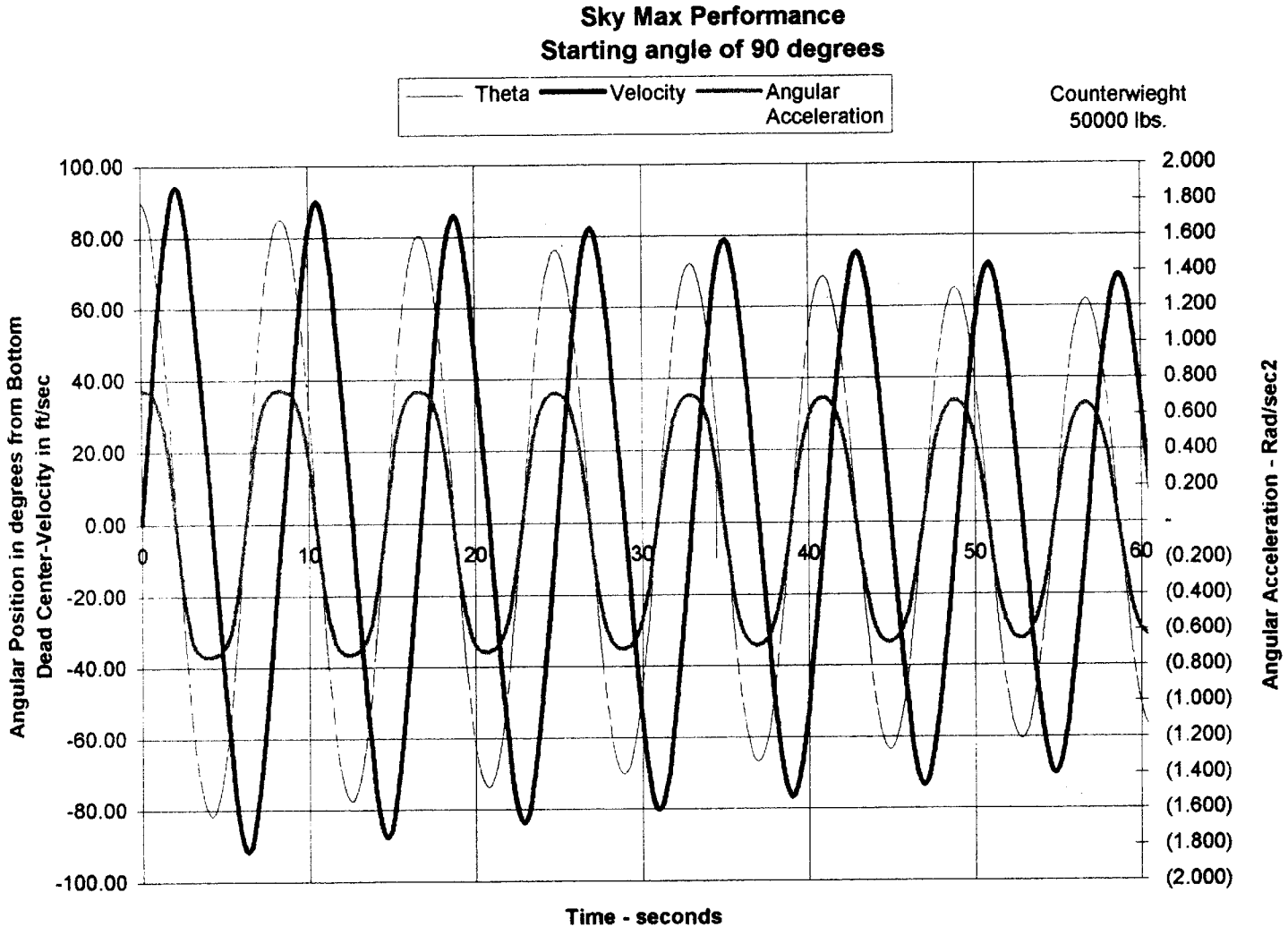

Referring to FIG. 7, a sample calculation shows the typical magnitude of the negative "g"s experienced by the riders.

Assume Aerodynamic properties:

$$S = 50\ \text{ft}^2 \quad C_d = 1.0 \quad \text{Rho} = .073 \cdot \frac{\text{lb}}{\text{ft}^3} \quad D_{const} = S \cdot C_d \cdot \frac{\text{Rho}}{2}$$

Assume Damper Qualities:

$$f_{damping} = 100\ \text{ft. lbf sec}$$

$$\text{step} = 1000\ \text{Cycles} = 5 \quad i = 1 \ldots \text{step} \quad \Delta t = \frac{\text{Cycles}}{\text{step}}$$

$$\Delta t = 0.038\ \text{sec}$$

$$t_O = 0\ \text{sec}$$

$$t_i = t_{(i-1)} + \Delta t$$

| | |
|---|---|
| $W_p = 1000$ lbf | Weight of seat and passengers |
| $L_p = 80$ ft | Distance from pivot to passengers |
| $W_f = 5000$ lbf | Weight of frame |
| $L_f = 22$ ft | Distance from pivot to arm center of gravity |
| $W_{cw} = 48000$ lbf | Weight of counterweight |
| $L_{cw} = 15$ ft | Distance from pivot to centroid of counterweight |
| $W_T + W_p + W_f + W_{cw}$ | Total Weight of System $W_T = 5.4 \cdot 10^4$ lbf |
| $X_0 = \dfrac{W_T \cdot L_{cw} - L_f \cdot W_f - L_{cw} \cdot (W_f + W_p) - L_p \cdot W_p}{W_T}$ | Distance ce from pivot to system center of gravity |
| $X_o = 9.815$ ft | |
| $h_p = 5$ ft | $h_f = 100$ ft. $h_{cw} = 5$ ft. |
| $I_p = \dfrac{W_p \cdot h_p^2}{9}$ | $I_f = \dfrac{W_f \cdot h_f^2}{9}$ $I_{cw} = \dfrac{W_{cw} \cdot h_{cw}^2}{9}$ |
| | $I_p = 2.778 \cdot 10^3$ ft$^2$ lbf<br>$I_f = 5.556 \cdot 10^6$ ft$^2$ lbf<br>$I_{cw} = 1.333 \cdot 10^5$ ft$^2$ lbf |

Moment of inertia at pivot point:

$$I_{px} = I_p + Lp^2 \cdot Wp \quad I_{fx} = I_f + L_f^2 \cdot W_f \quad I_{cw} = I_{cw} + L_{cw}^2 \cdot W_{cw}$$

$$I_{px} = 6.403 \cdot 10^6\ \text{ft}^2 \cdot \text{lbf} \quad I_{fx} = 7.976 \cdot 10^6\ \text{ft}^2 \cdot \text{lbf}$$

$$I_{cw} = 1.093 \cdot 10^7\ \text{ft}^2 \cdot \text{lbf}$$

$$I_x = I_{px} + I_{fx} + I_{cw} \quad \text{system moment of inertia}$$

$$I_x = 2.531 \cdot 10^7\ \text{ft}^2 \cdot \text{lbf}$$

$$q_0 = \frac{I_x}{W_T \cdot X_0} \quad \text{distance from pivot to center of precussion } q_0 = 47.758 \cdot \text{ft}$$

Assume rolling friction coefficient:

$$C_f = 0.01 \quad r = 0.5\ \text{ft} \quad M_{friction} = C_f \cdot r \cdot W_T \quad M_{friction} = 270\ \text{ft 1bf}$$

Starting with the swing at rest:

$$\theta_0 = 100\ \text{deg} \quad V_O = 0\ \text{mph}$$

$$M_{O_o} = W_T \cdot X_O \cdot \sin(\theta_0) - M_{friction} \quad M_{O_o} = 5.217 \cdot 10^5\ \text{ft lbf}$$

$$\alpha_{i-1} = \frac{M_{0_o}}{I_x}\ g \quad \text{angular acceleration } \alpha_0 = 0.663 \cdot \frac{\text{rad}}{\text{sec}^2}$$

$$\omega_{i-1} = 0\ \frac{\text{rad}}{\text{sec}} \quad \Delta t = 0.038\ \text{sec} \quad \text{Time}_0 = 0\ \text{sec}$$

$$i = 1\ \text{step}$$

$$\omega_i = \omega_i + \alpha_{i-1} \cdot \Delta t \quad \text{angular velocity}$$

$$\theta_i = \theta_{i-1} - .5 \cdot \alpha_{I-1} \cdot \Delta t^2 - \omega_{i-1} \cdot \Delta t \quad \text{angular position}$$

$$V_{Pi} = L_p \omega_i = \text{tangential vel.}$$

$$M_{0_i} = W_T \cdot X_O \sin(\theta_i) - M_{friction} - (V_{Pi})^2\ D_{const} L_p - f_{damping} \omega_i$$

$$\alpha_I = \frac{M_{0_i}}{I_x}\ g \quad \text{instantaneous angular acceleration}$$

$$G_I = \frac{(\omega_i)^2 \cdot L_p}{g} \quad G \text{ loads for passengers}$$

Figure 3:
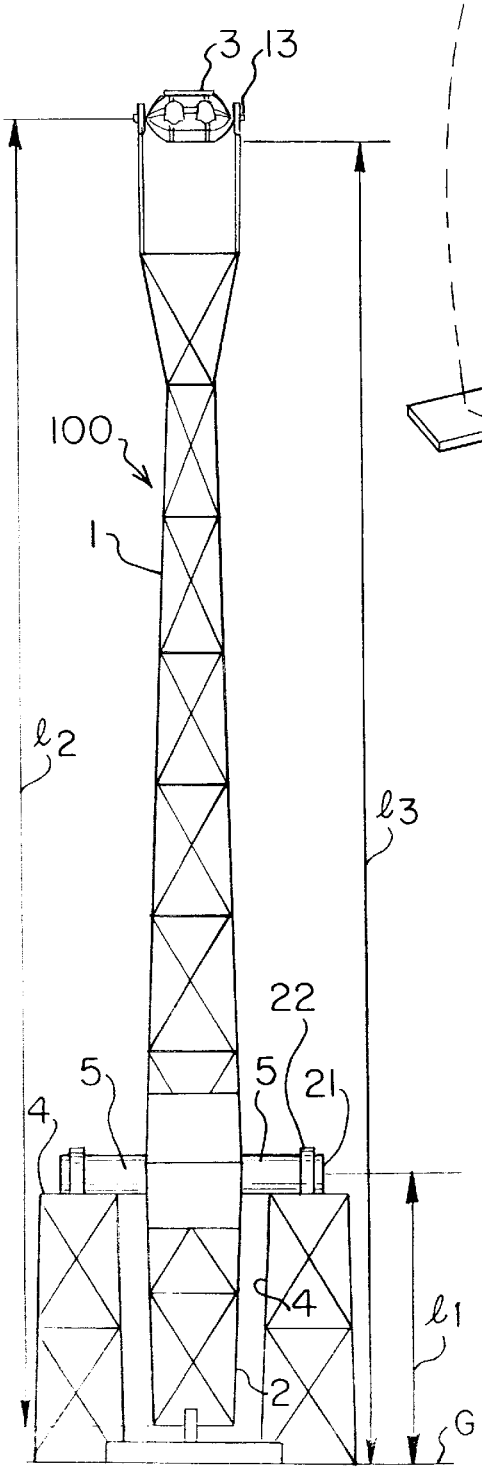
FIG. 3 is a front plan view of the preferred embodiment in an upright position.

FIG. 3 depicts the ride 100 in an upright position. Arm 1 is in a vertical position with rider capsule 3 at its maximum height, $1_3$. Fulcrum 5 rests on base 4. Fulcrum 5 is held at such a height so as to allow counterweight 2 to pass through base 4 and over the ground G without contacting the ground G. The overall length of arm 1, $1_2$ is usually at least 100 feet to create a thrilling ride. The length $1_1$ of the arm 1 from the fulcrum 5 to the end of counterweight 2 is 10 feet to 30 feet, or in the alternative 10% to 40% of the overall arm length $1_2$.

Figure 4:
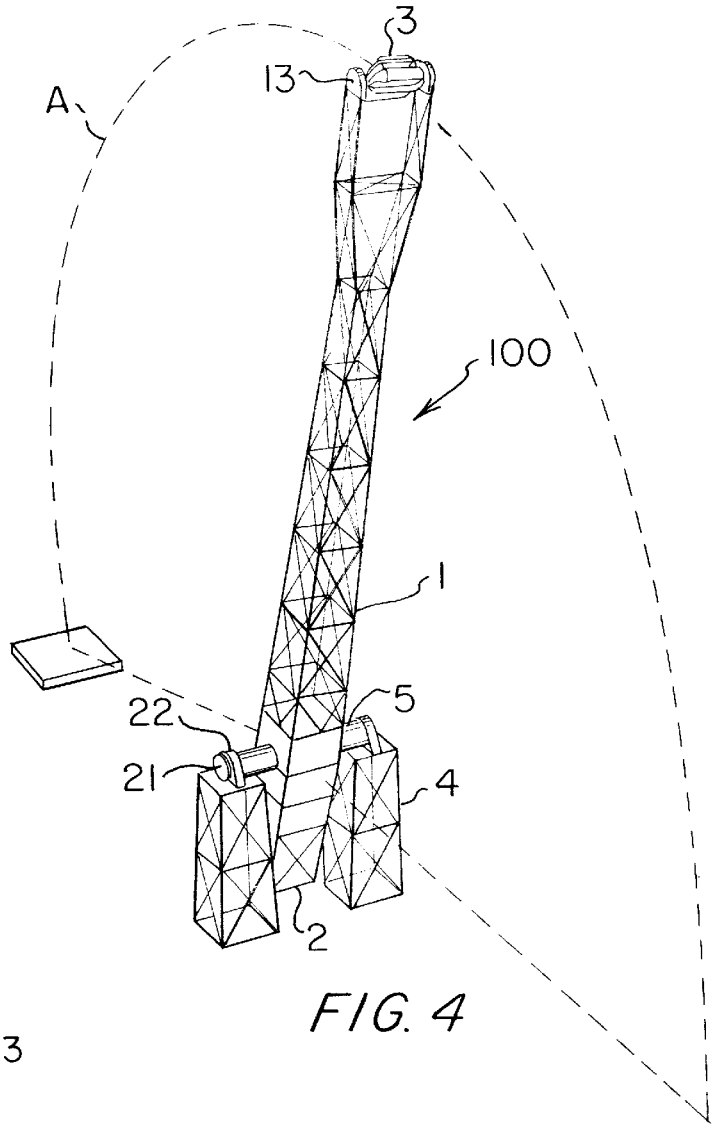
FIG. 4 is a top perspective view of the preferred embodiment showing the range of motion of the ride.

FIG. 4 depicts the range of motion of the ride 100 through arc A after release. Arm 1 oscillates through several cycles until coming to rest in the vertical position depicted in FIG. 3. From the vertical position, the arm 1 is lowered so rider capsule 3 is returned to ground level or an elevated platform (not shown).

Figure 5:
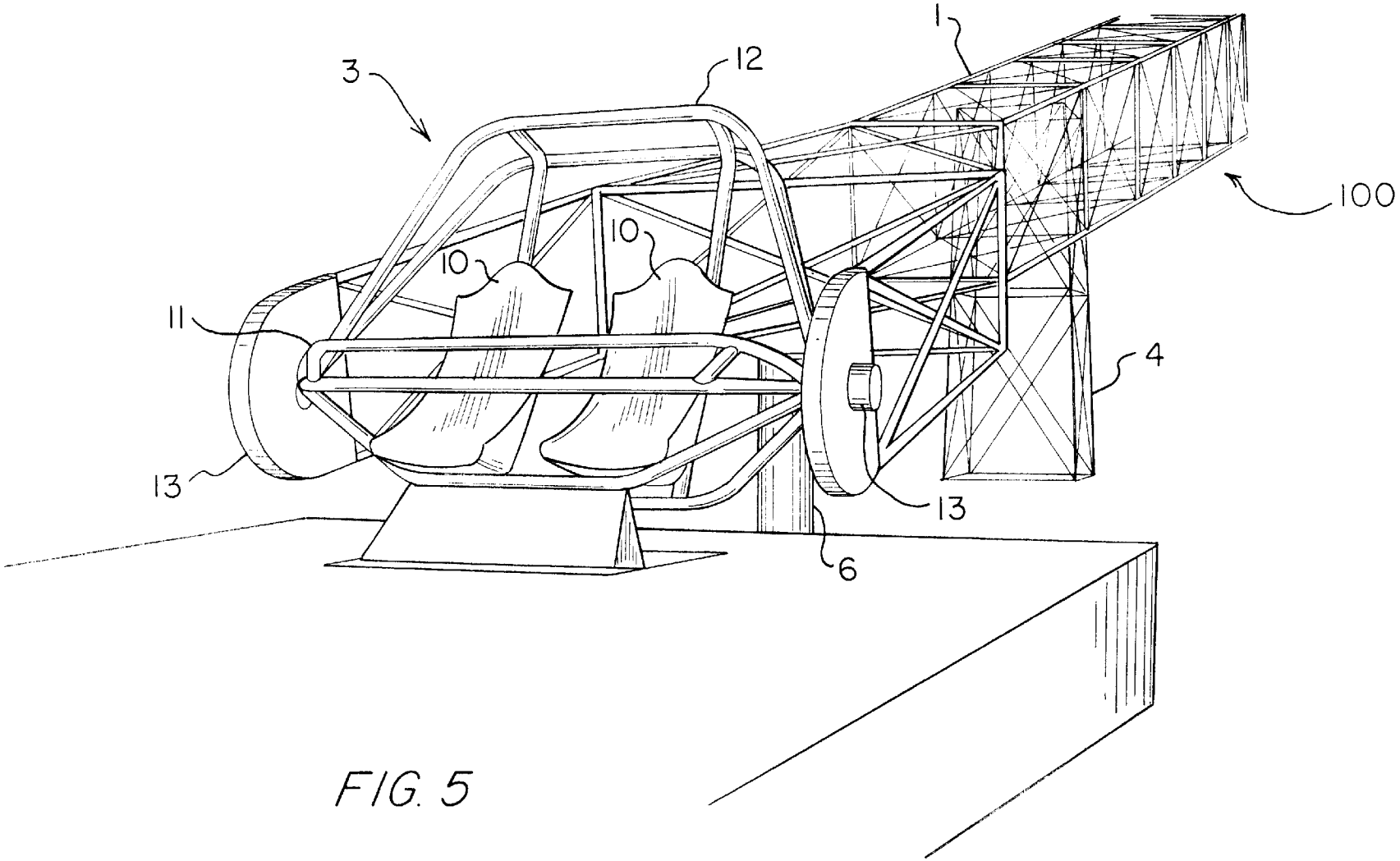
FIG. 5 is a perspective view of the rider capsule.

FIG. 5 is a detail of the rider capsule 3. The rider capsule 3 comprises seats 10 mounted within frame 12. An alternate embodiment of rider capsule 3 may contain several seats 10, up to 120. Retaining bar 11 opens to allow ingress and egress of riders (not shown) to seats 10. In an alternate embodiment, a five-point harness (not shown) is substituted for the retaining bar. In operation, rider capsule 3 rotates or spins freely about axle 13. The rider capsule 3 rotates through 360°.

Figure 6:
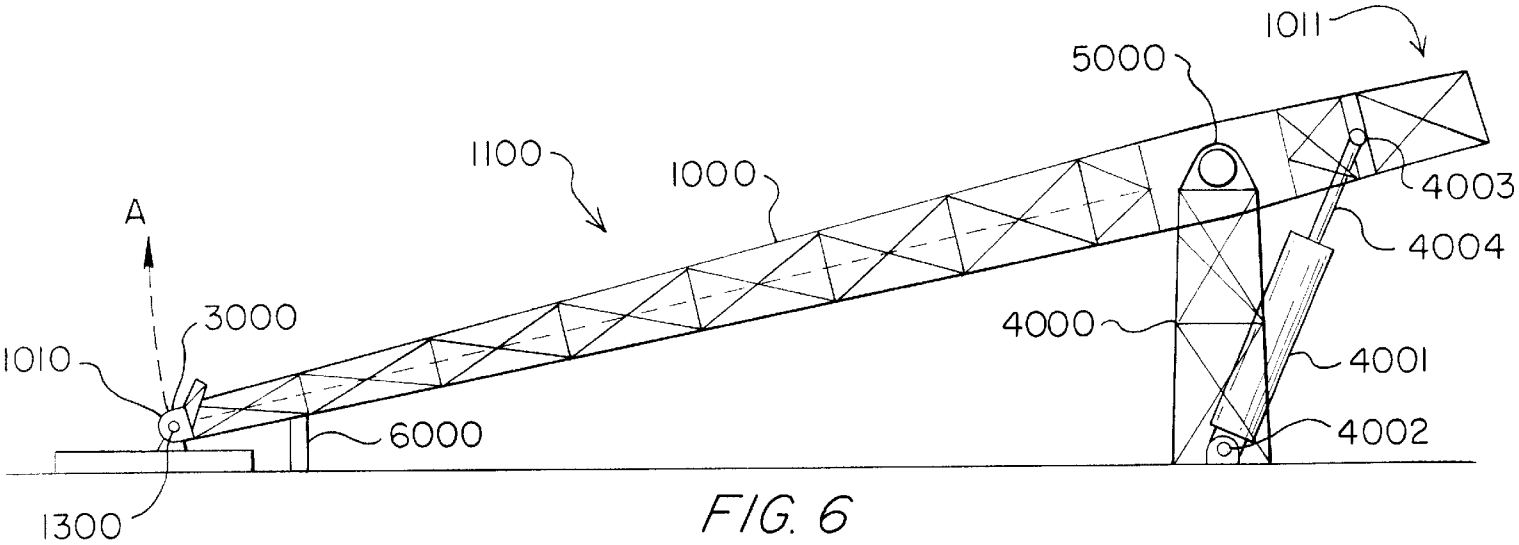
FIG. 6 is a perspective view of an alternate embodiment having a hydraulic power source to lift the arm.

Referring next to FIG. 6 an alternate embodiment, ride 1100, has an arm 1000 attached to base 4000 at non-centric fulcrum 5000. Attached to the arm 1000 at the distal end 1010 is a rider capsule 3000 which spins around axle 1300. The proximal end 1011 of arm 1000 is attached to push rod 4004 of hydraulic actuator 4001. The push rod 4004 has a pivotal connector 4003 preferably in the center of the arm 1000 to allow the arm 1000 to oscillate the same as the preferred embodiment shown in FIG. 1. Another pivotal connector 4002 allows the hydraulic actuator 4001 to pivot, thereby enabling the arm 1000 to function the same as the preferred embodiment but without any counterweight. A release 6000 functions the same as release 6 of FIG. 1.

In operation, hydraulic actuator 4001 is connected to the arm 1 at pivotal connector 4003 while arm 1 is in the vertical position. Hydraulic actuator 4001 then pushes on arm 1 causing the rider capsule 3000 to be lowered to the ground or an elevated platform. Release 6 of FIG. 1 then attaches to the arm 1 to hold it in place until the riders embark. The hydraulic actuator is then disconnected from the pivotal connector 4003 and moved out of the path of the arm 1. Release 6 is actuated by an operator and the arm 1 swings through the arc. The ride may be mechanically braked or damped to stop it. Once the ride stops, the process is repeated.

Figure 8:
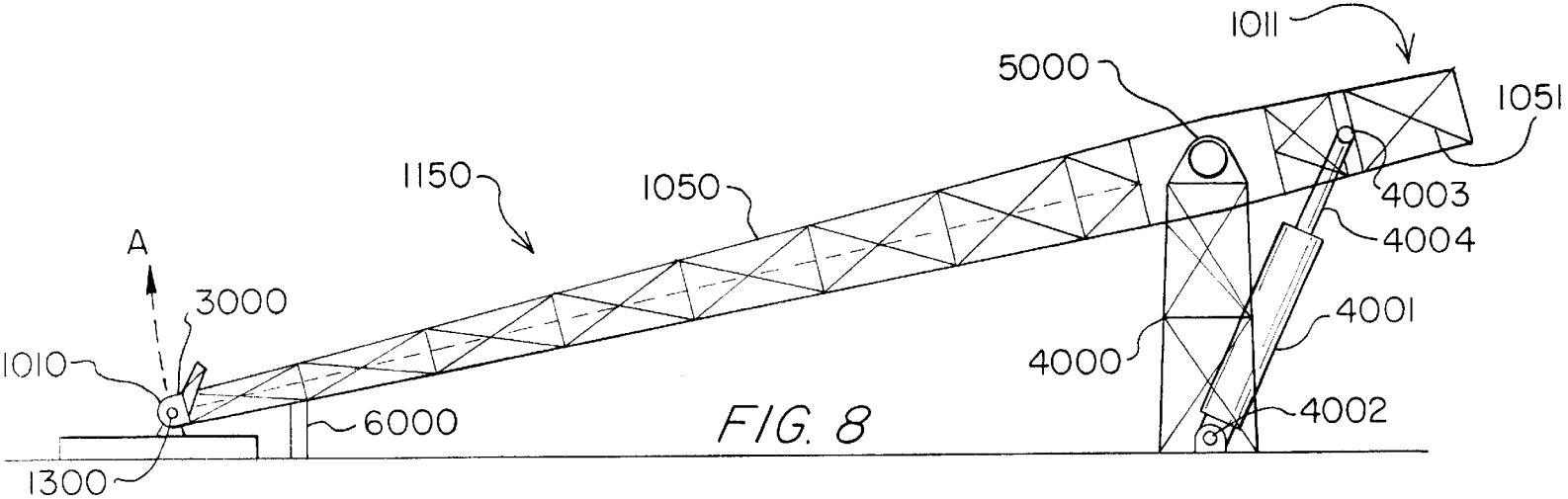
FIG. 8 is a side plan view of a second alternate embodiment having a counterweight and a hydraulic actuator.

Referring next to FIG. 8 yet another embodiment shows ride 1150 having the same components as the FIG. 6 embodiment. However, the arm 1050 also includes a counterweight 1051.

Figure 9:
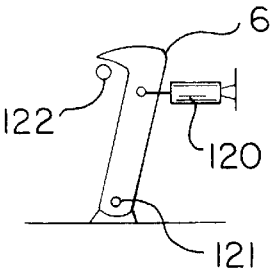
FIG. 9 is a detail of the release shown in FIG. 1.

FIG. 9 depicts a detail of the release. Release 6 is pivotally attached to the ground at pivot 121. Bar 122 is attached to arm 1. In operation, electromagnetic mechanism 120 is energized to retract release 6, thereby allowing arm 1 to rise.

FIGS. 10 through 15 depict graphical representations of various solutions for the equations described for FIG. 7.

Although the present invention has been described with reference to preferred embodiments, numerous modifications and variations can be made and still the result will come within the scope of the invention. No limitation with respect to the specific embodiments disclosed herein is intended or should be inferred.

I claim:

1. An amusement ride comprising:

a base mounted on a planar surface;

an arm having a non-centric fulcrum mounted to the base;

a rider capsule mounted to a distal end of the arm;

a fixed counterweight having a weight greater than the rider capsule loaded to a maximum capacity mounted to a proximal end of the arm; and a release mechanism to lock the arm in a rider-load mode and release the arm to launch the rider capsule in an upward arc powered by the counterweight, thereby causing a rider to experience first a positive "g" force and then a negative "g" force and causing the rider capsule to oscillate above the planar surface.

2. The amusement ride as claimed in claim 1, wherein said rider capsule further comprises a plurality of rider seats.

3. The amusement ride as claimed in claim 2, wherein said rider capsule further comprises a retaining bar for retaining a rider in a seat.

4. The amusement ride as claimed in claim 2, wherein said rider capsule further comprises a five-point harness on each rider seat.

5. The amusement ride as claimed in claim 1 further comprising a lowering mechanism on the fulcrum to lower said arm for loading the rider.

6. The amusement ride as claimed in claim 1, wherein said arm has a length of at least 100 feet.

7. The amusement ride as claimed in claim 1, wherein said non-centric fulcrum is located in the range of 10–40% away from the counterweight relative to a total length of the arm.

8. The amusement ride as claimed in claim 1 further comprising:

a hydraulic actuator to accelerate and lower said arm;

said hydraulic actuator attached at one end to said counterweight and attached at the opposite end to said base.

9. The amusement ride of claim 1, wherein said rider capsule further comprises a pivot mount on the distal end of the arm, thereby allowing the rider capsule to spin.

10. The amusement ride as claimed in claim 1, wherein said non-centric fulcrum further comprises an axle and a bearing.

11. An amusement ride comprising:

a base mounted on a planar surface;

an arm having a non-centric fulcrum mounted to the, base said non-centric fulcrum is located in the range of 10–40% away from the end of said arm relative to a total length of the arm;

a rider capsule mounted to a distal end of the arm;

an actuator mounted to a proximal end of the arm; and a release mechanism to lock the arm in a rider-load mode and release the arm to launch the rider capsule in an upward arc powered by the actuator, thereby causing a rider to experience first a positive "g" force and then a negative "g" force and causing the rider capsule to oscillate above the planar surface.

12. The amusement ride as claimed in claim 11, wherein said actuator further comprises a hydraulic actuator.

13. The amusement ride as claimed in claim 11, wherein said actuator further comprises an electric actuator.

14. The amusement ride as claimed in claim 11, wherein said actuator further comprises an air actuator.

15. An amusement ride comprising:

a base means functioning to support an arm above a planar surface;

said arm having a non-centric fulcrum mounted to the base means, said non-centric fulcrum is located in the range of 10–40% away from the end of said arm relative to a total length of the arm;

a rider capsule mounted to a distal end of the arm;

an actuator means functioning to start an oscillation of said arm; and a release means functioning to lock the arm in a rider-load mode and release the arm to launch the rider capsule in an upward arc powered by the counterweight, thereby causing a rider to experience first a positive "g" force and then a negative "g" force and causing the rider capsule to oscillate above the planar surface.

16. The amusement ride as claimed in claim 15, wherein said actuator means further comprises a fixed counterweight, wherein said non-centric fulcrum is located in the range of 10–40% away from the counterweight relative to a total length of the arm.

17. The amusement ride as claimed in claim 15, wherein said actuator means further comprises a hydraulic means.

18. An amusement ride comprising:

an arm eccentrically rotatably attached to a fulcrum;

said arm comprising a rider capsule containment at a distal end from the fulcrum a fixed counterweight located at a proximal end opposite said rider capsule;

said fulcrum having a non-centric location proximate said counterweight wherein said non-centric fulcrum is located in the range of 10–40% away from the counterweight relative to a total length of the arm;

a base supporting the fulcrum of sufficient height whereby said arm may oscillate through a vertical arc without the counterweight contacting the ground; and said non-centric fulcrum is located in the range of 10–40% away from the end of said arm relative to a total length of the arm.

19. An amusement ride comprising:

a base mounted on a planar surface;

an arm having a non-centric fulcrum mounted to the base;

a rider capsule mounted to a distal end of the arm;

a counterweight having a weight greater than the rider capsule loaded to a maximum capacity mounted to a proximal end of the arm;

a release mechanism to lock the arm in a rider-load mode and release the arm to launch the rider capsule in an upward arc powered by the counterweight, thereby causing a rider to experience first a positive "g" force and then a negative "g" force and causing the rider capsule to oscillate above the planar surface; and said non-centric fulcrum is located in the range of 10–40% away from the end of said arm relative to a total length of the arm.

* * * * *